US012291887B2

(12) United States Patent
Lu et al.

(10) Patent No.: US 12,291,887 B2
(45) Date of Patent: May 6, 2025

(54) OUTDOOR TENT

(71) Applicant: Zhejiang Tianji Leisure Products CO., LTD, Zhejiang (CN)

(72) Inventors: Shu Lu, Zhejiang (CN); Rongjie Lu, Zhejiang (CN)

(73) Assignee: Zhejiang Tianji Leisure Product CO., LTD, Zhejiang (CN)

( * ) Notice: Subject to any disclaimer, the term of this patent is extended or adjusted under 35 U.S.C. 154(b) by 231 days.

(21) Appl. No.: 18/177,682

(22) Filed: Mar. 2, 2023

(65) Prior Publication Data

US 2023/0383566 A1 Nov. 30, 2023

(30) Foreign Application Priority Data

May 30, 2022 (CN) ..... 202221314780.3
May 30, 2022 (CN) ..... 202221314817.2
May 30, 2022 (CN) ..... 202221314818.7

(51) Int. Cl.
*E04H 15/44* (2006.01)

(52) U.S. Cl.
CPC ..... *E04H 15/44* (2013.01)

(58) Field of Classification Search
CPC ..... E04H 15/44; E04H 15/34
See application file for complete search history.

(56) References Cited

U.S. PATENT DOCUMENTS 5,335,685 A * 8/1994 Dahulich ..... E04H 15/322 296/100.18
5,930,971 A * 8/1999 Etheridge ..... E04H 15/34 52/63
7,219,681 B1 * 5/2007 Hamilton-Jones .... E04H 15/322 135/123
7,389,785 B2 * 6/2008 Loudermilk ..... E04H 15/34 135/144
9,243,422 B2 * 1/2016 Hunt ..... E04H 15/18
10,184,264 B2 * 1/2019 Hunt ..... E04B 7/00
11,230,857 B2 * 1/2022 Yang ..... E04H 15/44
2006/0174929 A1 * 8/2006 Tseng ..... E04H 15/46 135/159
2007/0215191 A1 * 9/2007 Huang ..... E04H 15/44 135/131

(Continued)

FOREIGN PATENT DOCUMENTS

CN 203626378 6/2014

*Primary Examiner* — Noah Chandler Hawk
(74) *Attorney, Agent, or Firm* — JCIPRNET

(57) ABSTRACT

The present invention discloses an outdoor tent, including a tent frame and a tent roof, wherein the tent frame includes stand columns and tent beams; and the tent roof includes tent roof rods and a tent roof rod frame. By means of design optimization, matching of end plugs and brackets, and embedding mounting and elastic locking, quick assembly and mounting of the tent roof rods and the stand columns can be realized; the design is optimized, mounting seats are directly embedded and mounted in embedding grooves, and quick mounting of the tent roof rods and tent cross beams is realized by means of vertical clamping matching; extension pipes are designed in an optimized manner, and the tightness of a tarpaulin can be adjusted by means of matching of the extension pipes and tent long bones or tent short bones, and quick-assembly and quick-disassembly structures of the extension pipes are optimized.

18 Claims, 12 Drawing Sheets

(56) References Cited

U.S. PATENT DOCUMENTS

2010/0275962 A1* 11/2010 Park ..... E04H 15/50
135/144
2013/0145719 A1* 6/2013 Tseng ..... E04H 15/18
52/655.1

* cited by examiner

OUTDOOR TENT

CROSS-REFERENCE TO RELATED APPLICATION

This application claims the priority benefit of Chinese application serial no. 202221314817.2, filed on May 30, 2022, Chinese application serial no. 202221314818.7, filed on May 30, 2022, and Chinese application serial no. 202221314780.3, filed on May 30, 2022. The entirety of each of the above-mentioned patent application is hereby incorporated by reference herein and made a part of this specification.

BACKGROUND

Technical Field

The present invention relates to the technical field of outdoor tents, in particular to an outdoor tent.

Description of Related Art

With the constant pursuit of the improvement of people's living standards and lifestyles, outdoor activities become more and more popular among people. People often use tents when taking a rest in city square green space, in parks, on seaside beaches or beside swimming pools, and the tents are sheds that are supported on the ground to shelter people from the wind, the rain and the sunlight and are used for providing temporary residences.

Tent roofs and stand columns of the existing common tents are mounted through direct locking by means of fixing members or through welding fixing by means of angle iron members, resulting in relatively tedious fixing and mounting of the tents in the later period. Most tent products are export products, so the packaging requirements thereof are relatively high, and the design of mounting and dismounting structures is often adopted to reduce the transportation cost.

For this purpose, for example, a tent is disclosed in the publication number CN203626378U, which belongs to the technical field of leisure products, the tent comprises a tent support and a tarpaulin, wherein the tent support comprises a plurality of vertical rods erected on the ground, at least one cross beam is arranged between every two adjacent vertical rods, a frame shape is enclosed by the cross beams on the vertical rods, each cross beam comprises a left support rod and a right support rod, one end of the left support rod and one end of the right support rod are both fixedly connected to the upper end of the vertical rod, the other end of the left support rod is a first connecting end, the other end of the right support rod is a second connecting end, the first connecting end is connected to the second connecting end, and a connector for preventing the junction of the first connecting end and the second connecting end from being loosened is further arranged at the junction. In this design, assembling and mounting of auxiliary ejector rods and the cross beams are realized mainly by means of connecting buckle components; however, if the reduced buckle structure design is adopted, connecting buckles are required to be elastic to a certain extent; lateral clamping fixing is adopted for fixing at this position, so that the position is prone to loosening during long-term usage; particularly, under certain transverse stress influence, buckle falling occurs easily due to the aging problem, which affects the mounting stability of products.

In addition, tarpaulins of the existing tents are all fixed, the tarpaulins and tent frames fixedly match each other, due to materials of the tarpaulins, particularly due to the fact that the outdoor tents are placed outdoors for a long time, the tarpaulins are often hit by the wind and rain, and the problems of fluffing and collapsing of the tarpaulins appear easily due to accumulation of the rain and snow, which affects usage of the outdoor tents. Besides, during mounting of the outdoor tents, the tarpaulins need to be tensioned; however, during mounting, since the existing tarpaulins need to be in a tensioned state, the size requirements for the tent frames are relatively high during mounting; therefore, how to mount the tarpaulins quickly and make the tarpaulins in the tensioned state is a problem about mounting of the outdoor tents at present, and how to maintain and use the tarpaulins in the later period is also a technical problem to be solved.

SUMMARY

With regard to the above-mentioned problems, the present invention aims to provide an outdoor tent so as to facilitate quick assembly and mounting of the outdoor tent and facilitate mounting and dismounting, packaging and transportation and later maintenance and usage of the tent.

The technical problems can be solved by the present invention through the following technical solution:

an outdoor tent, comprising a tent frame and a tent roof, wherein the tent roof is mounted at an upper portion of the tent frame; the tent frame comprises a plurality of stand columns and tent beams configured to connect the stand columns; the tent roof comprises a plurality of tent roof rods and a tent roof rod frame located in the middle; end plugs are arranged at top ends of the stand columns; embedding grooves are formed in the end plugs; the tent roof rods are mounted on the end plugs in a matching manner by means of brackets; and each of the brackets comprises a tent roof rod fixing portion and an embedded pipe, the tent roof rod fixing portion is configured to be fixedly mounted on the corresponding tent roof rod, and the embedded pipe is configured to match the corresponding embedding groove in a clamping manner.

Fixing holes are formed in side walls of the stand columns corresponding to the embedding grooves, and spring bean members are arranged in the embedded pipes and are configured to match the fixing holes in a locking manner.

Each of the end plugs comprises an end plug body and an end plug cover, the outer diameter of the end plug cover is greater than the inner diameter of the corresponding stand column, and the end plug body is completely embedded and mounted in an inner cavity of the corresponding stand column.

Limiting and reinforcing ribs are arranged on an outer side wall of the end plug body.

The tent roof rod fixing portion comprises a tent roof rod bottom support surface and lug plates located on two sides of the tent roof rod bottom support surface, and a mounting groove for accommodating the corresponding tent roof rod is formed among the tent roof rod bottom support surface and the lug plates.

The tent roof rod bottom support surface is an outward inclined surface, mounting holes are formed in the lug plates, and a reinforcing plate is arranged between the tent roof rod fixing portion and the corresponding embedded pipe.

The outdoor tent further comprises section tent roof rods; outer sides of the section tent roof rods are mounted to and match the middles of tent cross beams of the tent beams; at least one embedding groove is formed in the middle of each of the tent cross beams; the embedding grooves are of an upward open structure and are configured to fixedly match mounting seats; and each of the mounting seats comprises clamping pipes configured to match the embedding grooves in an embedding manner and an assembling seat located at upper portions of the clamping pipes, and the assembling seat is configured to fixedly match the corresponding tent roof rod.

There are two embedding grooves and two clamping pipes, and the embedding grooves correspondingly match the clamping pipes.

The two clamping pipes are divided into a locking clamping pipe and an auxiliary clamping pipe, an elastic clamping member is arranged in the locking clamping pipe, a locking hole is formed in a side wall of each of the embedding grooves, the locking hole is configured to match and lock the elastic clamping member, and the auxiliary clamping pipe is shorter than the locking clamping pipe.

Each of the mounting seats further comprises side plates, clamping seams are formed between the side plates and the clamping pipes, and the clamping seams are configured to embed side walls of the embedding grooves.

Each of the assembling seats comprises lug plates and a bottom support plate, the lug plates are located on two sides of the bottom support plate to form an assembling groove, the assembling groove is configured to match the corresponding tent roof rod for mounting, and fixing holes are formed in the lug plates.

Each of the tent cross beams comprises a first cross beam frame and a second cross beam frame, the first cross beam frame and the second cross beam frame are mounted in an attached and fastened manner by means of a connector, and the two embedding grooves are located at ends of the first cross beam frame and the second cross beam frame respectively.

An upper portion of the tent roof is covered with a tarpaulin; the tent roof comprises a plurality of tent long bones, one end of each of the plurality of tent long bones is mounted in a matching manner by means of a tent roof disc, the other end of each of the plurality of tent long bones extends outwards to form a free end, the free ends of some or all of the tent long bones are provided with extension pipes in a matching manner, the extension pipes are configured to match the free ends of the tent long bones in a sleeving manner, the extension pipes are configured to match the tent long bones to realize extension and adjustment of the lengths of the free ends, and the extension pipes are configured to fixedly match an edge of the tarpaulin.

Each of the extension pipes comprises a pipe body, a pipe cavity and a pipe head, at least two locking holes are formed in the pipe body, the locking holes are in communication with the pipe cavity, a sliding groove opening is further formed in the pipe body, and the sliding groove opening is located at an end opening of the pipe cavity.

Three locking holes are formed in the pipe body.

Upper portions of the stand columns are configured to match the tent long bones for mounting, and the free ends of the tent long bones are provided with the extension pipes in a matching manner.

The free ends of the tent long bones are provided with spring bean members in a matching manner, and spring bean portions of the spring bean members protrude out of outer side walls of the tent long bones.

The tent roof further comprises tent short bones, the tent short bones are mounted on the tent long bones by means of support rods, and the tent short bones are configured to support the upper tarpaulin.

Outer side ends of the tent short bones are provided with extension pipes in a matching manner.

Outer ends of the tent short bones are provided with spring bean members in a matching manner, and spring bean portions of the spring bean members protrude out of outer side walls of the tent short bones.

Compared with the prior art, the present invention has the following beneficial effects: according to the present invention, by means of design optimization, matching of the end plugs and the brackets, and embedding mounting and elastic locking, quick assembly and mounting of the tent roof rods and the stand columns can be realized, thereby facilitating quick assembly and disassembly of the tent roof and the tent frame, reducing packaging and transportation costs, and facilitating assembly and disassembly of a product at the same time; the design is optimized, the mounting seats are directly embedded and mounted in the embedding grooves, and quick mounting of the tent roof rods and the tent cross beams is realized by means of vertical clamping matching, thereby improving the mounting convenience, facilitating assembly and disassembly of the product, and achieving the good mounting stability at the same time; the extension pipes are designed in an optimized manner, and the tightness of the tarpaulin can be adjusted by means of matching of the extension pipes and the tent long bones or the tent short bones, thereby facilitating mounting and later maintenance of the tent; and quick-assembly and quick-disassembly structures of the extension pipes are optimized, thereby facilitating quick fixing and mounting to the tent roof and improving the mounting efficiency.

The features of the present invention can be clearly understood by referring to drawings of this case and detailed description of following preferred embodiments.

DESCRIPTION OF THE EMBODIMENTS

In order to make the technical means, creative features, achievement goals and effects achieved by the present invention easy to understand, the present invention will be further described below in conjunction with specific illustrations.

Embodiment 1

Figure 1:
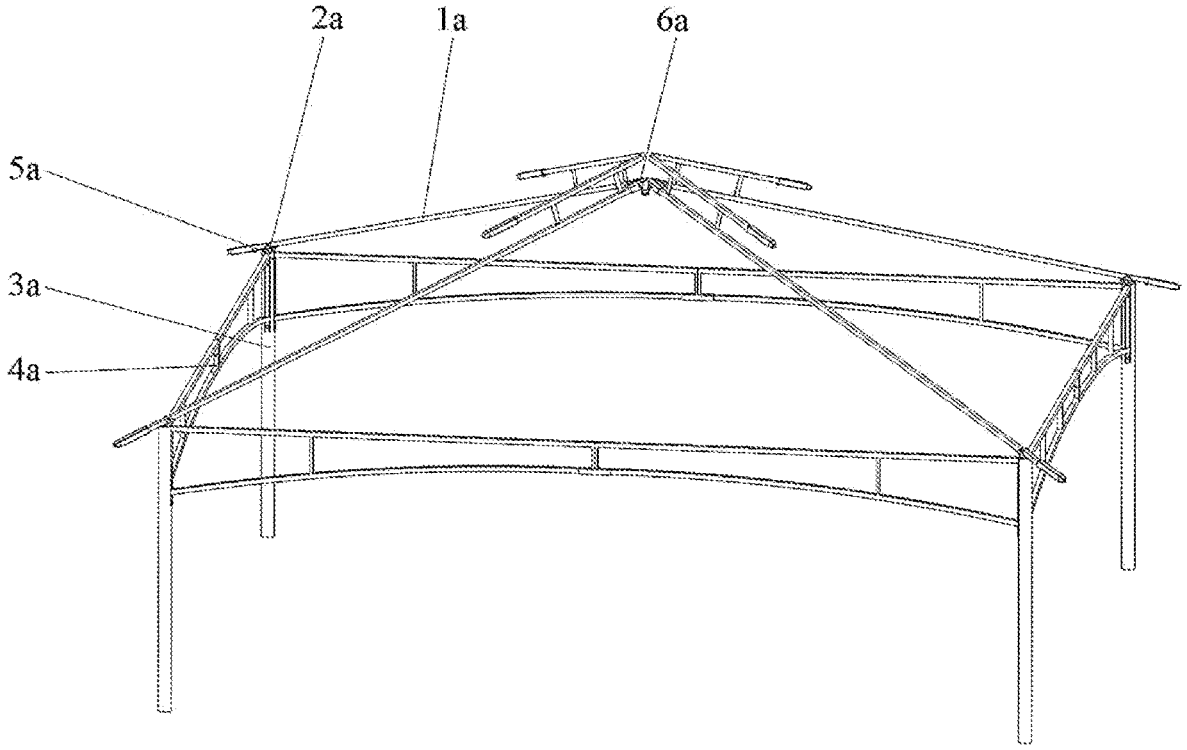
FIG. 1 is a first schematic diagram of an overall mounting structure of the present invention.
Figure 2:
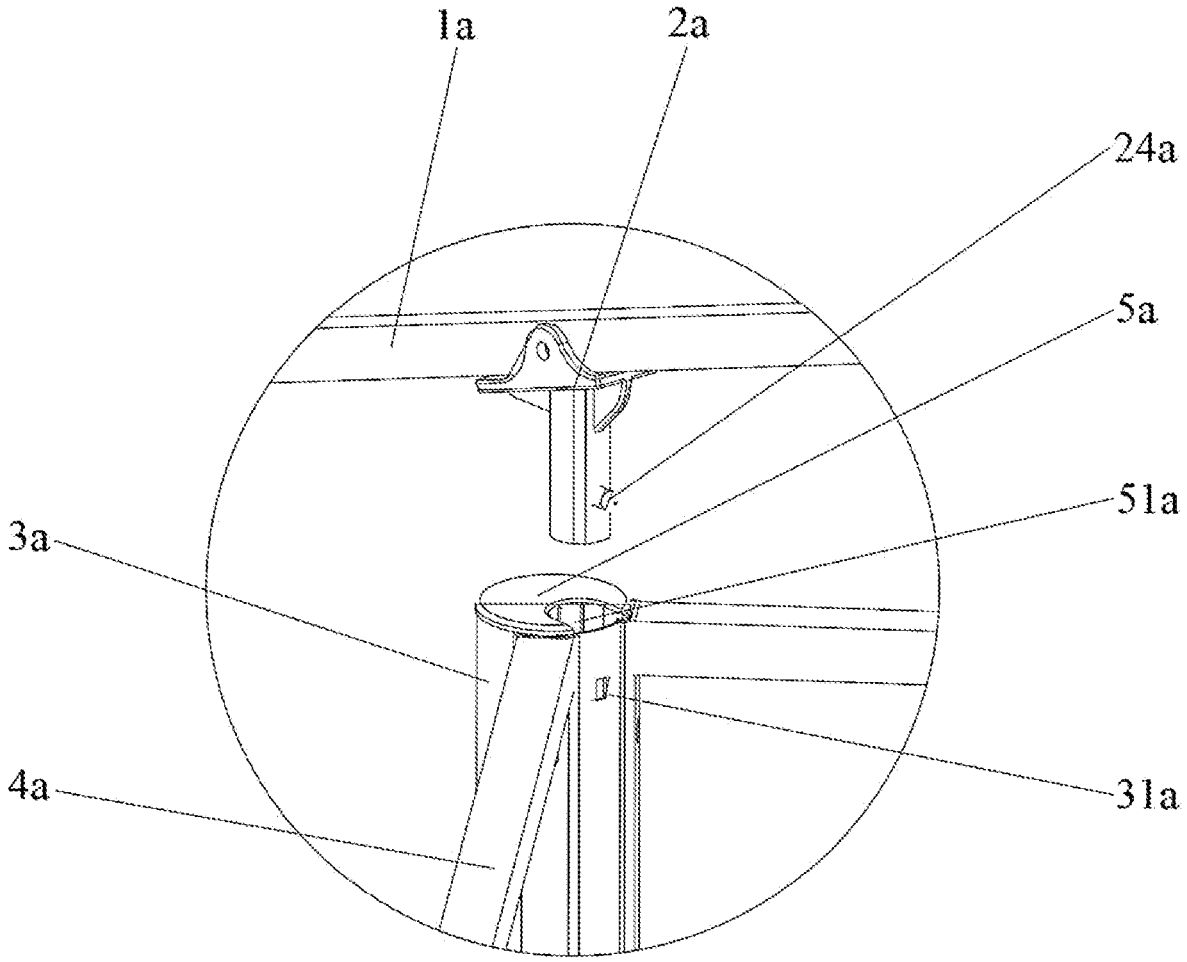
FIG. 2 is a schematic diagram of a mounting structure of a tent roof rod frame and a stand column of the present invention.
Figure 3:
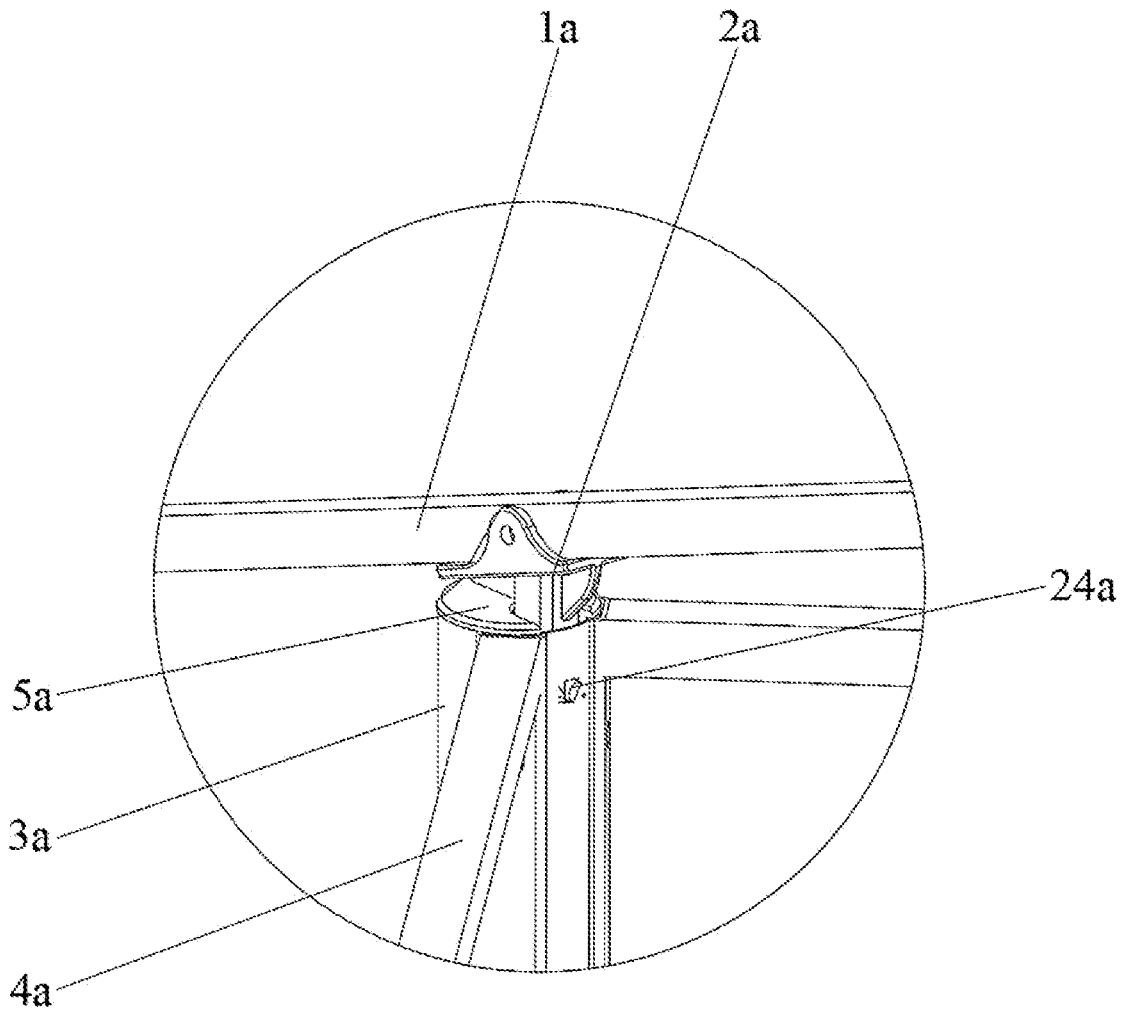
FIG. 3 is a schematic diagram of a breakdown mounting structure of the tent roof rod frame and the stand column of the present invention.
Figure 4:
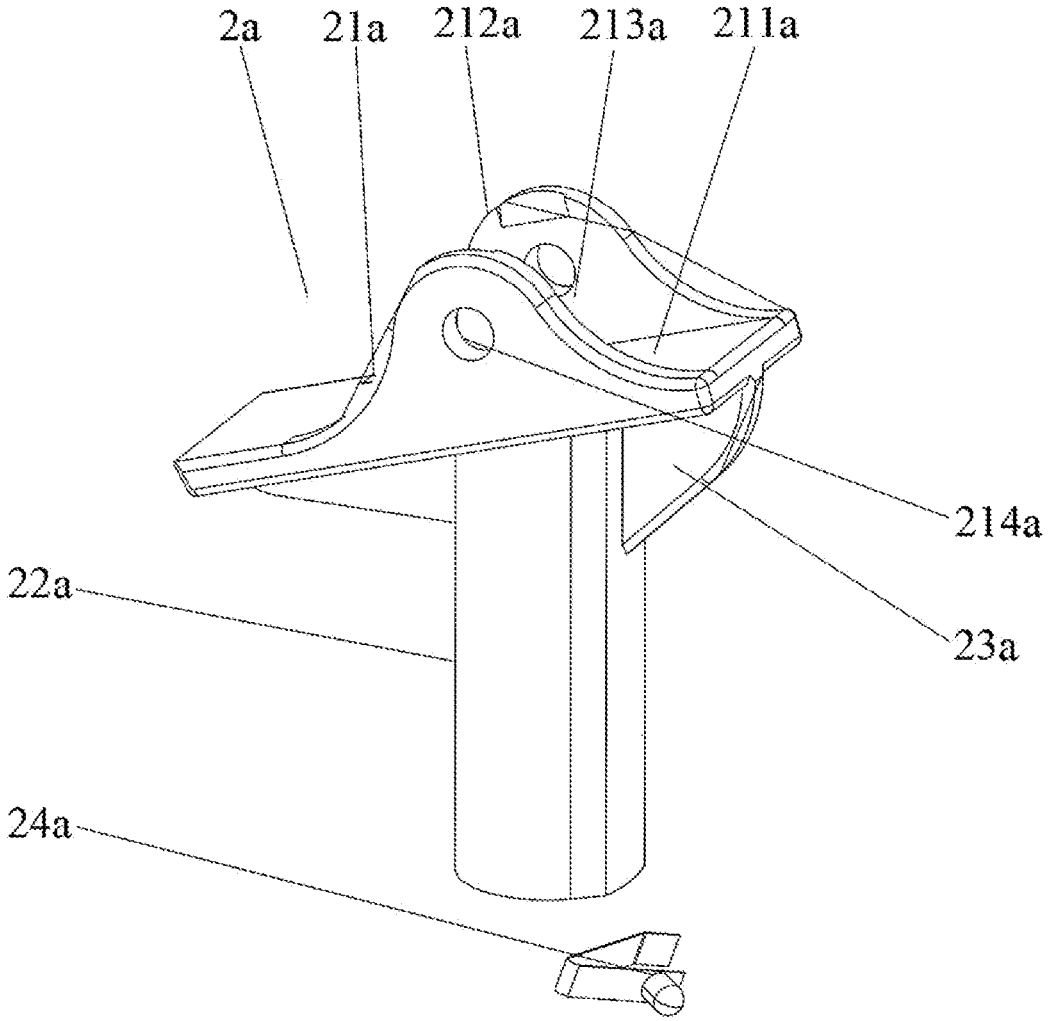
FIG. 4 is a structure diagram of a bracket of the present invention.
Figure 5:
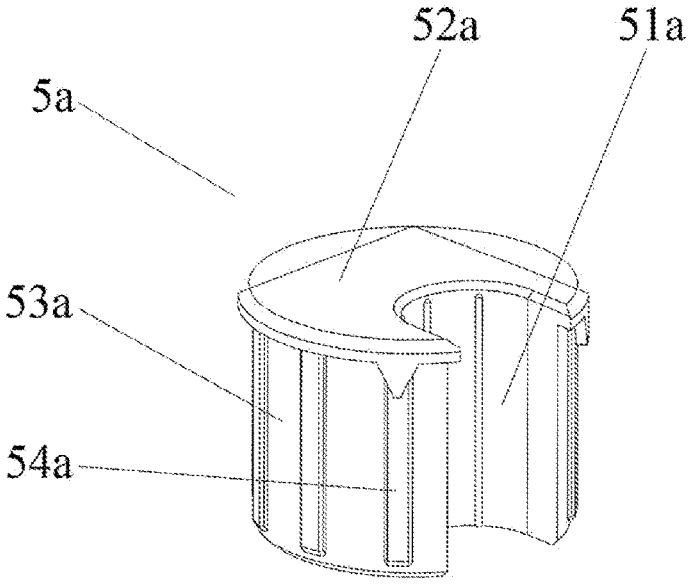
FIG. 5 is a structure diagram of an end plug of the present invention.

As shown in FIGS. 1-5, this embodiment discloses an outdoor tent, comprising a tent frame and a tent roof; stand columns of the tent and a top quick-assembly structure of the tent are designed in an optimized manner; the tent frame comprises a plurality of stand columns 3*a* and tent beams 4*a* configured to connect the stand columns 3*a*; the tent roof comprises a plurality of tent roof rods 1*a* and a tent roof rod frame 6*a* located in the middle; the tent roof is configured to support a tarpaulin; portions of the tent roof rods 1*a* close to the middles are configured to match with the tent roof rod frame 6*a* for mounting; the tent roof rod frame 6*a* is a central connecting component; the tent roof rods 1*a* are arranged radially around the tent roof rod frame 6*a* which serves as the center; and the tent roof rods 1*a* are inclined downwards and outwards from the center.

Preferably, end plugs 5*a* are arranged at top ends of the stand columns 3*a*, embedding grooves 51*a* are formed in the end plugs 5*a*, the tent roof rods 1*a* are mounted on the end plugs 5*a* in a matching manner by means of brackets 2*a*, each of the brackets 2*a* comprises a tent roof rod fixing portion 21*a* and an embedded pipe 22*a*, the tent roof rod fixing portion 21*a* is configured to be fixedly mounted on the corresponding tent roof rod 1*a*, and the embedded pipe 22*a* is configured to match the corresponding embedding groove 51*a* in a clamping manner; and the design of the structure with the end plugs 5*a* matching the brackets 2*a* is optimized, and quick mounting and fixing of the tent roof rods 1*a* and the stand columns 3*a* are realized by means of quick-assembly and quick-disassembly structures between the components, thereby facilitating quick building of the tent frame and the tent roof.

In the specific structure, each of the end plugs 5*a* comprises an end plug body 53*a* and an end plug cover 52*a*, wherein the outer diameter of the end plug cover 52*a* is greater than the inner diameter of the corresponding stand column, the end plug cover 52*a* is located at an end of the stand column 3*a* to plug the end of the stand column 3*a*, and the end plug body 53*a* is completely embedded and mounted in an inner cavity of the stand column 3*a*; limiting and reinforcing ribs 54*a* are arranged on an outer side wall of the end plug body 53*a*, and the friction force between the end plug body 53*a* and the stand column 3*a* is increased through the structure arrangement of the limiting and reinforcing ribs 54*a*, thereby preventing the end plug 5*a* from being deflected after being mounted; in addition, the outer diameter of the end plug body 53*a* is usually equal to the inner diameter of the inner cavity of the stand column 3*a*, or slightly greater than the inner diameter of the inner cavity of the stand column 3*a*, and the mounting stability is improved through interference fit.

In the mounting structure, fixing holes 31*a* are formed in side walls of the stand columns 3*a* corresponding to the embedding grooves 51*a*, and spring bean members 24*a* are arranged in the embedded pipes 22*a* and are configured to match the fixing holes 31*a* in a locking manner; in the mounting process, the embedded pipes 22*a* are embedded and mounted along the embedding grooves 51*a*, the spring bean members 24*a* correspond to the side walls of the inner cavities of the stand columns 3*a*, after the embedded pipes moves downwards continuously, spring bean portions of the spring bean members 24*a* abut against the inner side walls of the stand columns due to press-fitting and are ejected until being aligned with the fixing holes 31*a*, and fixing and locking are completed.

Preferably, the tent roof rod fixing portion 21*a* comprises a tent roof rod bottom support surface 211*a* and lug plates 212*a* located on two sides of the tent roof rod bottom support surface 211*a*, a mounting groove 213*a* for accommodating the corresponding tent roof rod is formed among the tent roof rod bottom support surface 211*a* and the lug plates 212*a*, the tent roof rod bottom support surface 211*a* is an outward inclined surface, and the mounting groove 213*a* structure is configured to match the tent roof rod 1*a* in specification so as to facilitate embedding and mounting of the tent roof rod 1*a* to form a similar U-shaped covering structure; meanwhile, mounting holes 214*a* are formed in the lug plates 212*a*, fastening and matching are completed through combination of fixing members, the mounting holes 214*a* and the tent roof rod 1*a*; in other embodiments, the tent roof rod 1*a* may also be fixedly mounted at the tent roof rod fixing portion 21*a* through welding; in addition, a reinforcing plate 23*a* is arranged between the tent roof rod fixing portion 21*a* and the corresponding embedded pipe 22*a*, and the mounting strength is enhanced by means of the reinforcing plate 23*a*.

On the basis of the above, the structures of the end plugs 5*a* and the brackets 2*a* are used in the present invention, wherein the brackets 2*a* are configured to match the tent roof rods 1*a*, so that the tent roof rods 1*a* in tent roof components can be separated as independent components, and during assembly, all that is required to form an integral tent roof structure is to dock the plurality of tent roof rods 1*a* at the center by means of the tent roof rod frame 6*a*; the end plugs 5*a* match the ends of the stand columns 3*a*, detachable structures are used between the stand columns 3*a* and the tent beams 4*a*, thus components such as the stand columns 3*a*, the tent beams 4*a*, the tent roof rods 1*a* and the like can be folded, transportation and packaging of objects are facilitated, the transportation cost is reduced, and meanwhile, later assembly and mounting are facilitated.

According to the present invention, by means of design optimization, matching of the end plugs and the brackets, and embedding mounting and elastic locking, quick assembly and mounting of the tent roof rods and the stand columns can be realized, thereby facilitating quick assembly and disassembly of the tent roof and the tent frame, reducing the packaging and transportation costs, and facilitating assembly and disassembly of the product at the same time.

Embodiment 2

Figure 6:
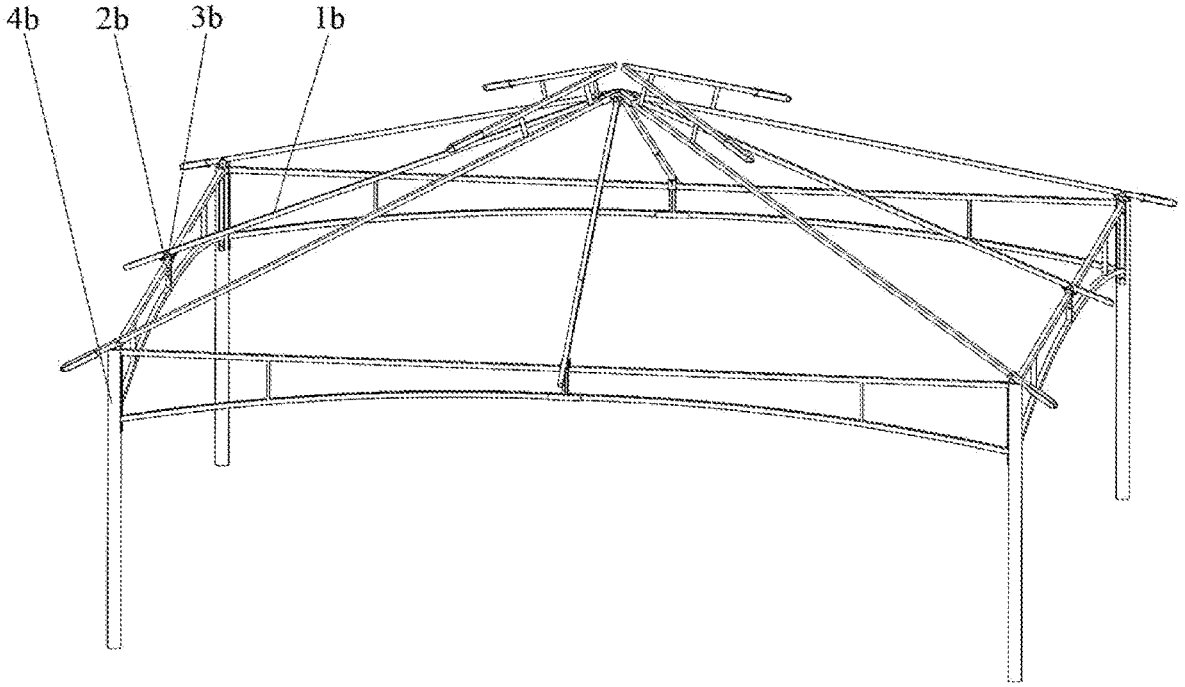
FIG. 6 is a second schematic diagram of the overall mounting structure of the present invention.
Figure 7:
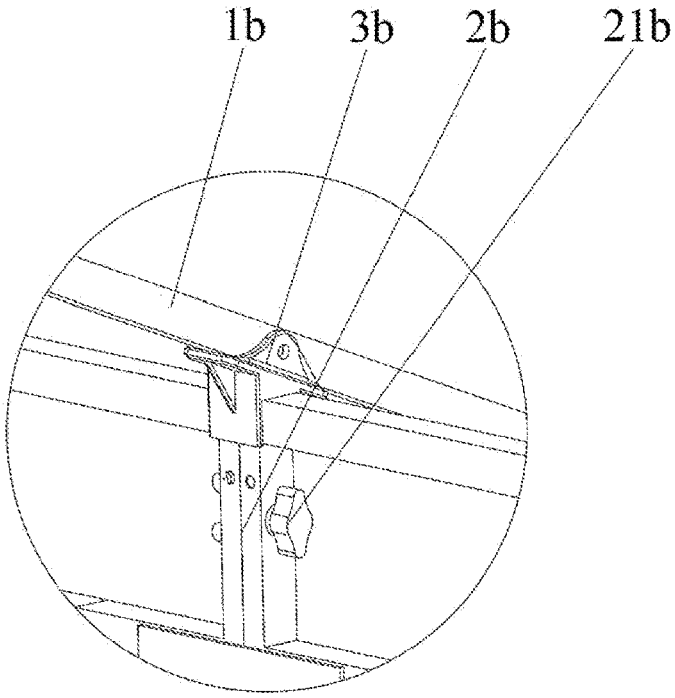
FIG. 7 is a schematic diagram of a mounting structure of a tent roof rod, a tent cross beam and a mounting seat of the present invention.
Figure 8:
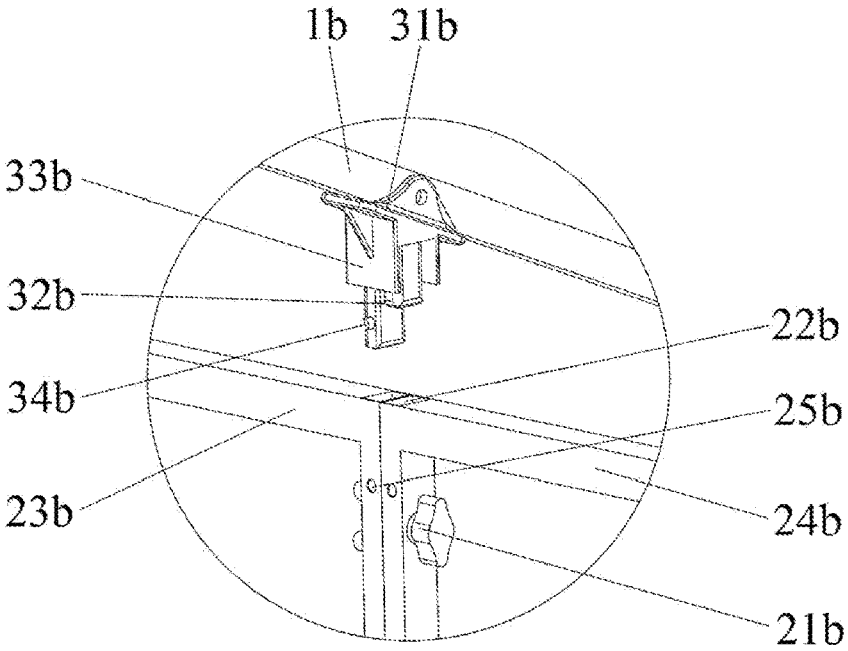
FIG. 8 is a schematic diagram of a breakdown mounting structure of the tent roof rod, the tent cross beam and the mounting seat of the present invention.
Figure 9:
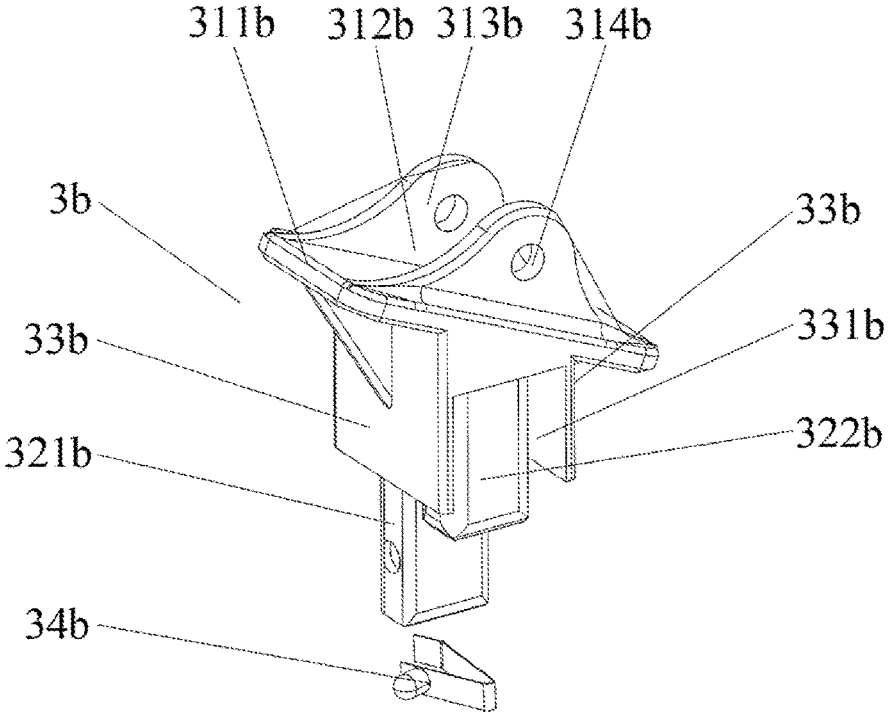
FIG. 9 is a structure diagram of the mounting seat of the present invention.

On the basis of Embodiment 1, as shown in FIGS. 6-9, this embodiment discloses an outdoor tent, comprising a tent frame and a tent roof; cross beams of the tent and a top quick-assembly structure of the tent are designed in an optimized manner; the tent roof is mounted at an upper portion of the tent frame; an upper portion of the tent roof is covered with a tarpaulin; and the tent roof comprises a plurality of tent roof rods 1*b*, wherein according to the specification design of the tent, there are at least six tent roof rods 1*b* in this embodiment, and preferably, there are eight tent roof rods 1*b*, which are divided into the tent roof rods 1*b* configured to match stand columns 4*b* for mounting and the tent roof rods 1*b* configured to match tent cross beams 2*b* for mounting.

On the basis of the above, the tent frame comprises the stand columns 4*b* and tent beams, wherein the tent beams are mainly the tent cross beams 2*b* configured to connect the stand columns 4*b*; outer sides of the tent roof rods 1*b* are mounted in the middles of the tent cross beams 2*b* to realize middle support of the tent roof; and the tent roof of such tent has the relatively large dimensions and specification, so that the middle tent roof rods 1*b* are used to match the tent cross beams for mounting, which increases the overall bearing of the tent roof In the specific mounting structure, at least one embedding groove 22*b* is formed in the middle of each of the tent cross beams 2*b*, the embedding grooves 22*b* are of an upward open structure and are configured to fixedly match mounting seats 3*b*, each of the mounting seats 3*b* comprises clamping pipes 32*b* configured to match the embedding grooves 22*b* in an embedding manner and an assembling seat 31*b* located at upper portions of the clamping pipes 32*b*, and the assembling seat 31*b* is configured to fixedly match the corresponding tent roof rod 1*b*; and the mounting seats 3*b* are receiving components and are configured to realize quick assembly and disassembly of the tent cross beams 2*b* and the tent roof rods 1*b*, the structures of the mounting seats 3*b* are optimized, meanwhile, embedding grooves 22*b* of the upward open structure are formed, vertical assembly is convenient to realize, and the stability after mounting can be improved through combination with the dead weight of the components.

In the preferred structure, the tent cross beams 2*b* usually adopt the two-end structure design, each of the tent cross beams 2*b* comprises a first cross beam frame 23*b* and a second cross beam frame 24*b*, the first cross beam frame 23*b* and the second cross beam frame 24*b* are mounted in an attached and fastened manner by means of a connector 21*b*, and the two embedding grooves 22*b* are located at ends of the first cross beam frame 23*b* and the second cross beam frame 24*b* respectively, so that there are two embedding grooves 22*b*, preferably, there are two clamping pipes 32*b*, and the embedding grooves 22*b* correspondingly match the clamping pipes 32*b*; and preferably, the first cross beam frame 23*b* and the second cross beam frame 24*b* are arranged symmetrically and are of the same structures.

In one of the preferred embodiments, the two clamping pipes 32*b* are divided into a locking clamping pipe 321*b* and an auxiliary clamping pipe 322*b*, an elastic clamping member 34*b* is arranged in the locking clamping pipe 321*b*, a locking hole 25*b* is formed in a side wall of each of the embedding grooves 22*b*, the locking hole 25*b* is configured to match and lock the elastic clamping member 34*b*, and the auxiliary clamping pipe 322*b* is shorter than the locking clamping pipe 321*b*; the elastic clamping member 34*b* is preferably a spring bean member, the locking clamping pipe 321*b* is a hollow pipe, the elastic clamping member 34*b* is arranged in an inner cavity of the locking clamping pipe 321*b*, a spring bean portion of the spring bean member protrudes out via a through hole, positioning and locking are realized by means of the spring bean portion and the locking hole 25*b* located in the side wall of the embedding groove 22*b*, a locking structure is added to facilitate limiting, and meanwhile, later disassembly is facilitated; in the specific structure, the clamping pipes 32*b* at high and low positions are preferred, the auxiliary clamping pipe 322*b* is added, the first cross beam frame 23*b* and the second cross beam frame 24*b* can be assembled by means of the single component such as the mounting seat 3*b*, the mounting stability between the two can be improved, meanwhile, the mounting seat 3*b* further comprises side plates 33*b*, clamping seams 331*b* are formed between the side plates 33*b* and the clamping pipes 32*b*, the clamping seams 331*b* are configured to embed side walls of the embedding grooves 22*b*, and the mounting stability between the mounting seat 3*b* and the tent cross beam 2*b* is further improved by means of clamping matching of the clamping seams 331*b* and the side walls of the embedding grooves 22*b*.

In one of the preferred embodiments, the two clamping pipes 32*b* adopt the same structure design and both adopt the structure of the locking clamping pipe 321*b*. Refer to the above for the specific mounting structure of the locking clamping pipes 321*b* and the embedding grooves 22*b*.

On the basis of any above-mentioned embodiment, each of the assembling seats 31*b* comprises lug plates 312*b* and a bottom support plate 311*b*, the lug plates 312*b* are located on two sides of the bottom support plate 311*b* to form an assembling groove 313*b*, the assembling groove 313*b* is configured to match the corresponding tent roof rod 1*b* for mounting, and fixing holes 314*b* are formed in the lug plates 312*b*; the outer end of the tent roof rod 1*b* is usually clamped in the assembling groove 313*b*, and the fixing holes 314*b* in the lug plates 312*b* match fixing members such as screws, bolts and the like to realize fixed mounting of the tent roof rod 1*b*; and in other embodiments, the tent roof rod 1*b* is directly fixed through welding after being embedded in the assembling groove 313*b*, and the mounting seat 3*b* is directly welded and fixed to the outer end of the tent roof rod 1*b*.

According to the present invention, the design is optimized, the mounting seats are directly embedded and mounted in the embedding grooves, and quick mounting of the tent roof rods and the tent cross beams is realized by means of vertical clamping matching, thereby improving the mounting convenience, facilitating assembly and disassembly of the product, and achieving the good mounting stability at the same time.

Embodiment 3

Figure 10:
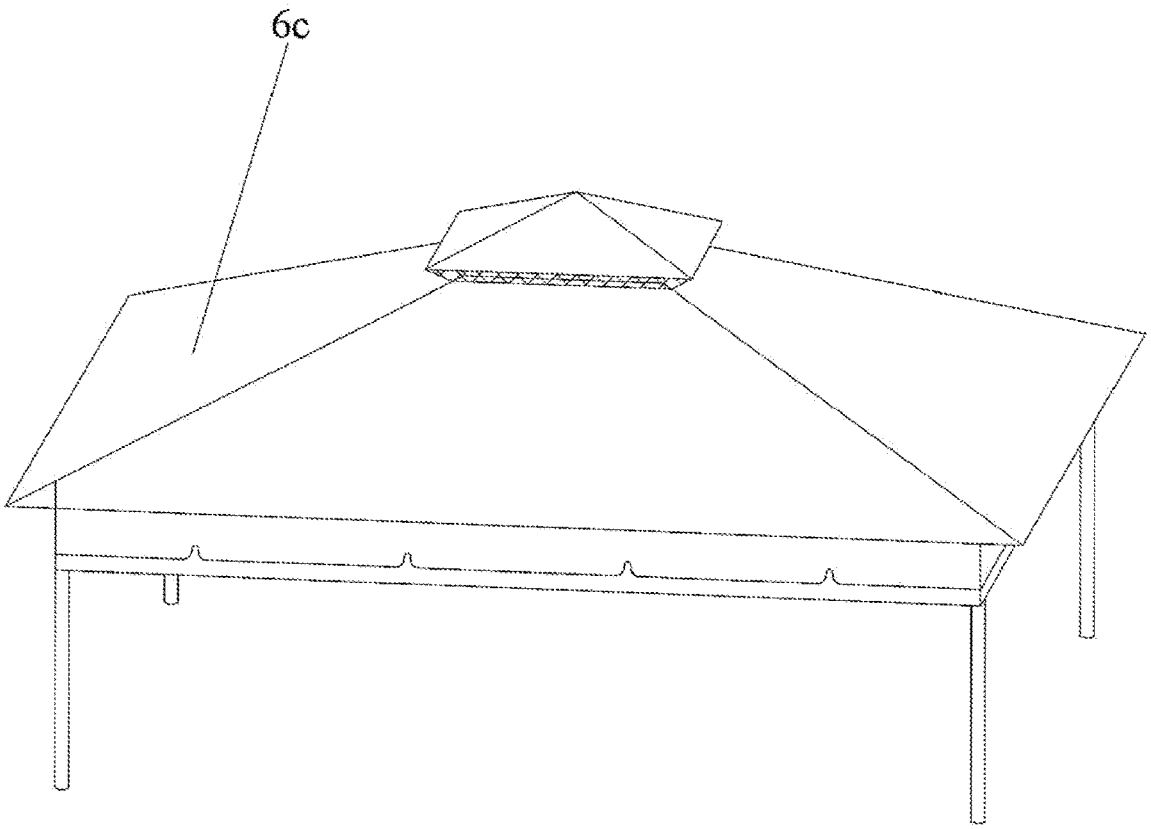
FIG. 10 is a third schematic diagram of the overall mounting structure of the present invention.
Figure 11:
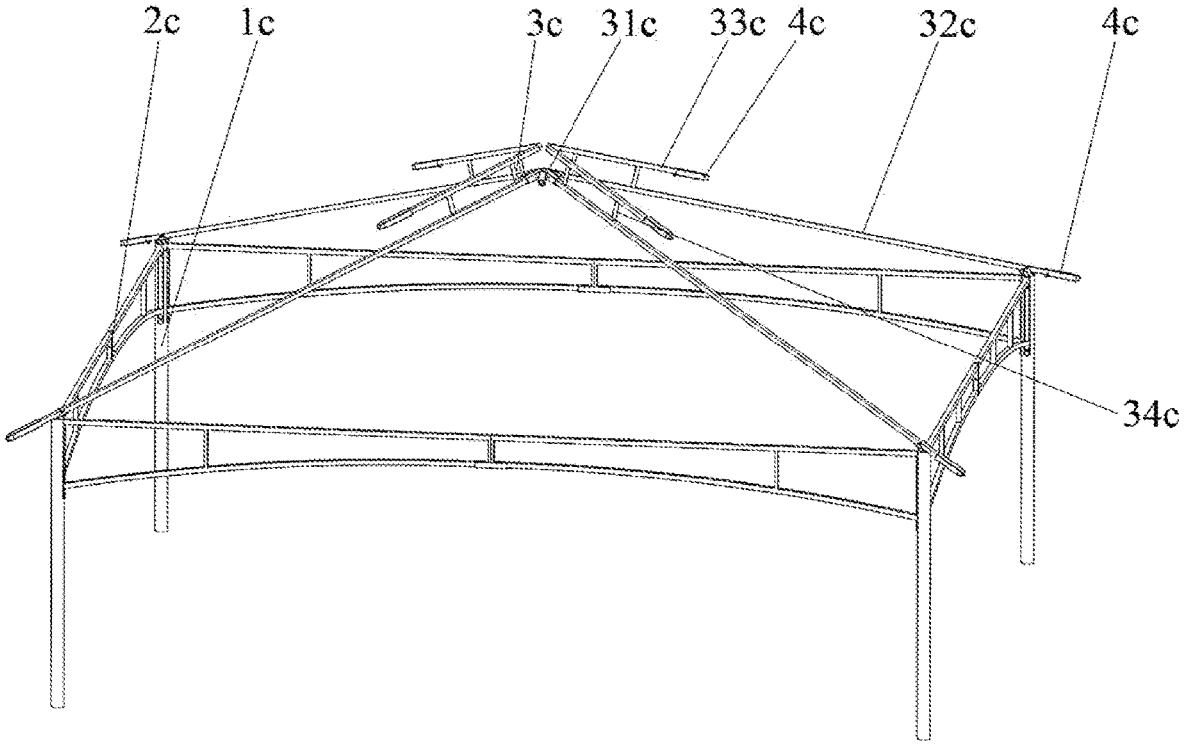
FIG. 11 is a fourth schematic diagram of the overall mounting structure of the present invention.
Figure 12:
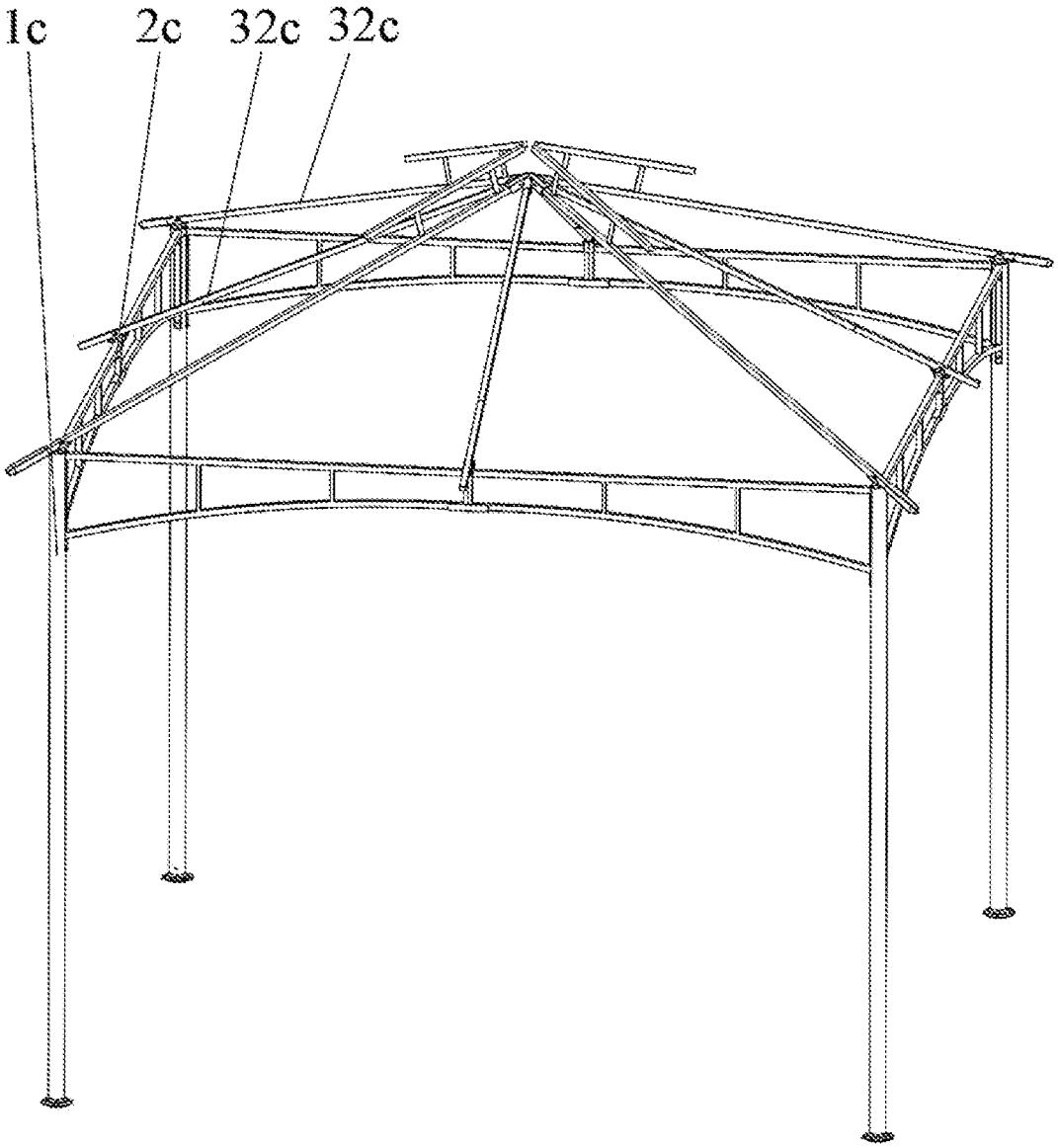
FIG. 12 is a fifth schematic diagram of the overall mounting structure of the present invention.
Figure 13:
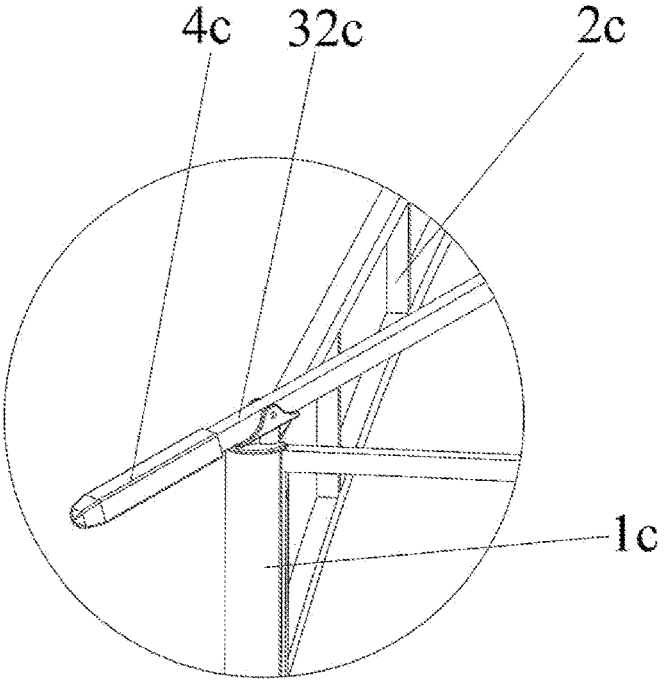
FIG. 13 is a first schematic diagram of a mounting structure of a tent long bone and an extension pipe of the present invention.
Figure 14:
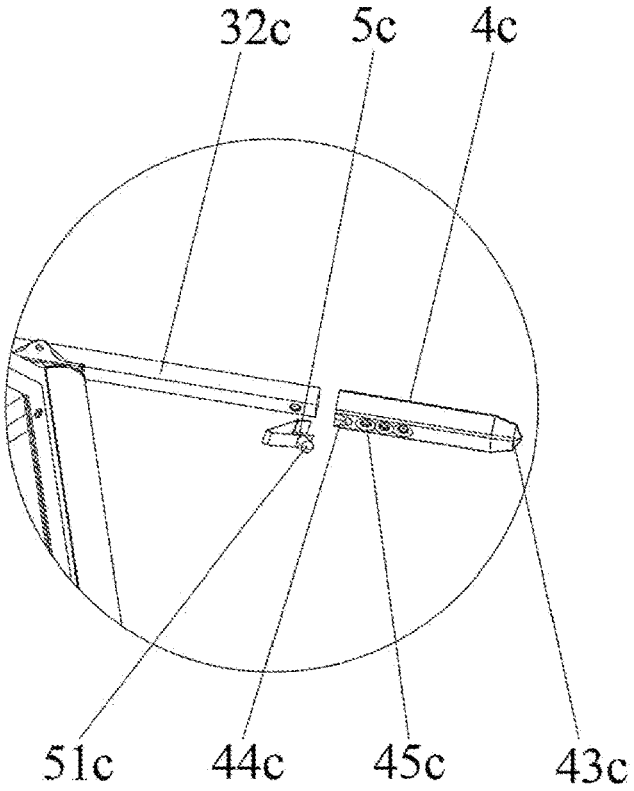
FIG. 14 is a schematic diagram of a breakdown mounting structure of the tent long bone and the extension pipe of the present invention.
Figure 15:
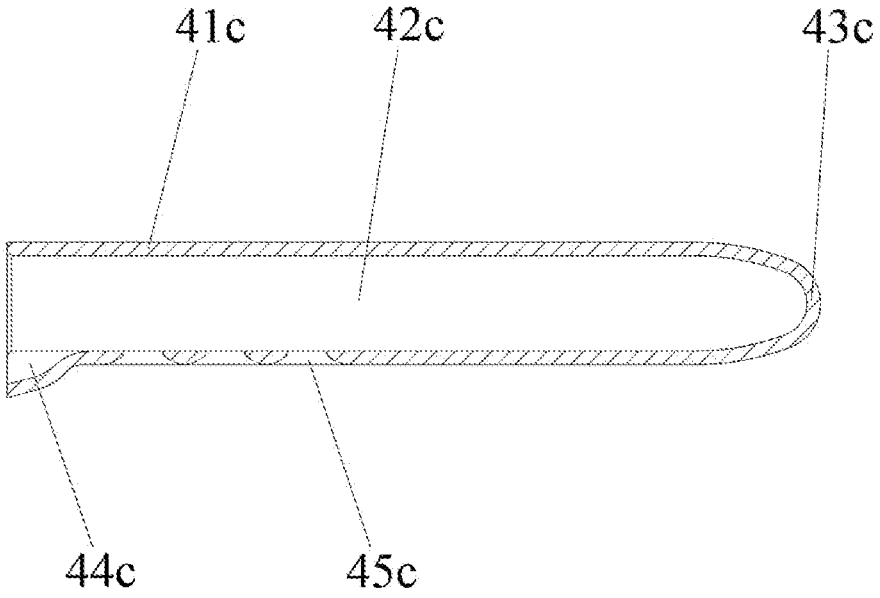
FIG. 15 is a section-view structure diagram of the extension pipe of the present invention.
Figure 16:
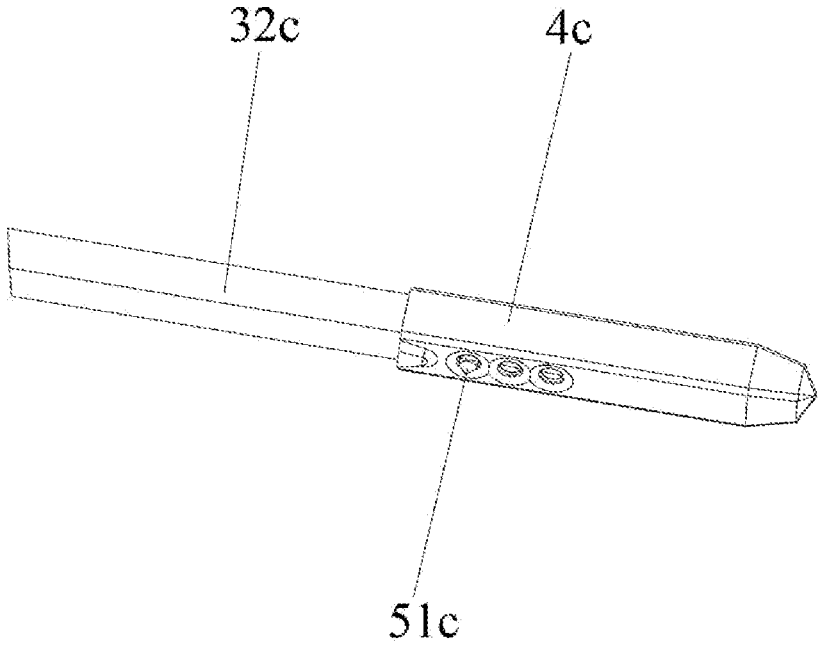
FIG. 16 is a second schematic diagram of the mounting structure of the tent long bone and the extension pipe of the present invention.
Figure 17:
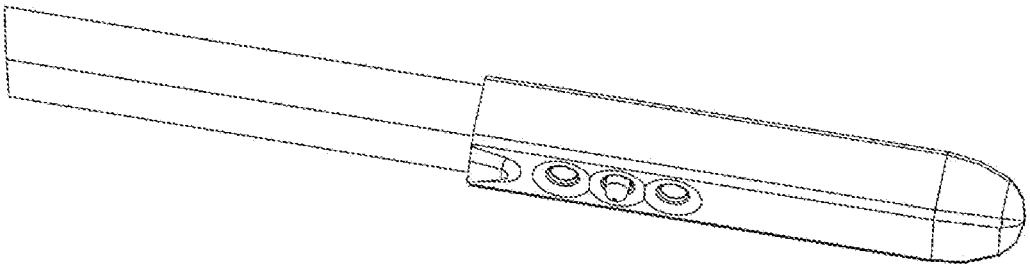
FIG. 17 is a third schematic diagram of the mounting structure of the tent long bone and the extension pipe of the present invention.
Figure 18:
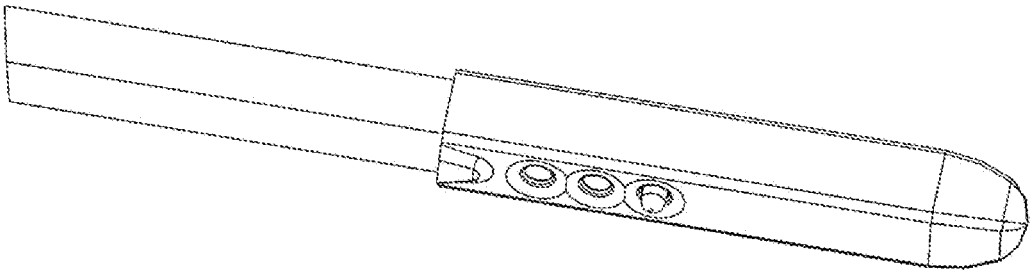
FIG. 18 is a fourth schematic diagram of the mounting structure of the tent long bone and the extension pipe of the present invention.

On the basis of Embodiment 1 or Embodiment 2, as shown in FIGS. 10-18, this embodiment discloses an outdoor tent, comprising a tent frame and a tent roof; a tightness adjusting mechanism for a roof tarpaulin of the outdoor tent is designed in an optimized manner, the mechanism comprises a tent roof 3*c*, tent beams 2*c* and stand columns 1*c*, wherein the tent beams 2*c* are arranged between every two adjacent stand columns 1*c* in a matching manner, the tent roof 3*c* is configured to match the stand columns 1*c* or/and the tent beams 2*c* for mounting, an upper portion of the tent roof 3*c* is covered with a tarpaulin 6*c*, the tent roof 3*c* comprises a plurality of tent long bones 32*c*, one end of each of the plurality of tent long bones 32*c* is mounted in a matching manner by means of a tent roof disc 31*c*, the other end of each of the plurality of tent long bones 32*c* extends outwards to form a free end, the free ends of some or all of the tent long bones 32*c* are provided with extension pipes 4*c* in a matching manner, the extension pipes 4*c* are configured to match the free ends of the tent long bones 32*c* in a sleeving manner, the extension pipes 4*c* are configured to match the tent long bones 32*c* to realize extension and adjustment of the lengths of the free ends, and the extension pipes 4*c* are configured to fixedly match an edge of the tarpaulin 6*c*.

In one of the embodiments, upper portions of the stand columns 1*c* are configured to match the tent long bones 32*c* for mounting, the free ends of the tent long bones 32*c* are provided with the extension pipes 4*c* in a matching manner, there are four tent long bones 32*c*, one end of each tent long bone fixedly matches by means of the tent roof disc 31*c*, the other end fixedly matches the stand column 1*c* for mounting and partially extends to the outer side, the ends of the portions of the tent long bones 32*c* extending to the outer side are configured to match the extension pipes 4*c* for mounting, and outer ends of the extension pipes 4*c* are configured to fix corners of the tarpaulin 6*c* to support and spread the tarpaulin 6*c*; and the mounting structures of the extension pipes 4*c* and the tent long bones 32*c* are designed in an optimized manner, the positions of the extension pipes 4*c* can be adjusted on the tent long bones 32*c* so as to adjust the length, thus the tightness of the tarpaulin 6*c* in the lengthwise direction of the tent long bones 32*c* can be adjusted, and mounting and later maintenance of the tarpaulin 6*c* can be facilitated.

In one of the embodiments, there are six or eight tent long bones 32*c*, four of which are configured to match the stand columns 1*c* for mounting, and the rest are configured to match the tent beams 2*c* for mounting; the free ends of the outer ends of the tent long bones 32*c* matching the stand columns 1*c* for mounting are provided with the extension pipes 4*c* in a matching manner, the extension pipes are configured to match the tarpaulin 6*c* for mounting, and the remaining tent long bones 32*c* are not required to match the extension pipes 4*c*; and in another preferred embodiment, all the tent long bones 32*c* are provided with the extension pipes 4*c* in a matching manner so as to realize multi-point adjustment of the edge of the tarpaulin 6*c*.

In the remaining embodiments, according to the specifications of the outdoor tent, for example, the outdoor tent having six stand columns arranged continuously and the outdoor tent having eight stand columns, all the tent long bones matching in the single tent roof can be provided with the extension pipes for adjustment of the tarpaulin.

On the basis of the above, the free ends of the tent long bones 32*c* are provided with spring bean members 5*c* in a matching manner, spring bean portions 51*c* of the spring bean members 5*c* protrude out of outer side walls of the tent long bones 32*c*, and the spring bean portions 51*c* protruding out of the outer side walls of the tent long bones 32*c* are configured to match locking holes in the extension pipes 4*c*; each of the extension pipe 4*c* comprises a pipe body 41*c*, a pipe cavity 42*c* and a pipe head 43*c*, at least two locking holes 45*c* are formed in the pipe body 41*c*, the locking holes 45*c* are in communication with the pipe cavity 42*c*, a sliding groove opening 44*c* is further formed in the pipe body 41*c*, and the sliding groove opening 44*c* is located at an end opening of the pipe cavity 42*c*; in the specific mounting structures of the extension pipes 4*c* and the tent long bones 32*c*, the extension pipes 4*c* are sleeved on the outer ends of the tent long bones 32*c* by means of the pipe cavities 42*c* to realize embedding until the spring bean portions 51*c* in the spring bean members 5*c* slide into the pipe cavities 42*c* via the sliding groove openings 44*c*; due to the elastic structure design of the spring bean members 5*c*, matching with the adjacent locking holes 45*c* is completed after continuous sliding, ejection is completed, and fixed matching of the extension pipes 4*c* and the tent long bones 32*c* is realized; by means of the telescopic structures of the spring bean portions 51*c*, matching of the locking holes 45*c* at corresponding positions can be realized according to requirements, thereby adjusting the sizes of the extension pipes 4*c* in the lengthwise direction of the tent long bones 32*c* and adjusting the tightness of the tarpaulin 6*c*; three locking holes 45*c* are formed in the preferred pipe body 41*c*, so that three-position adjustment can be realized; and the positions of the locking holes 45*c* can be formed separately according to product requirements.

In one of the preferred embodiments, the tent roof 3*c* further comprises tent short bones 33*c*, the tent short bones 33*c* are mounted on the tent long bones by means of support rods 34*c*, the tent short bones 33*c* are configured to support the upper tarpaulin 6*c*, outer side ends of the tent short bones 33*c* are provided with extension pipes 4*c* in a matching manner, outer ends of the tent short bones 33*c* are provided with spring bean members 5*c* in a matching manner, and spring bean portions 51*c* of the spring bean members 5*c* protrude out of outer side walls of the tent short bones 33*c*; and the tent roof 3*c* is of a double-roof structure, the top small roof design is adopted, the matching structures of the tent short bones 33*c* and the extension pipes 4*c* are optimized, and the tightness of the top small roof tarpaulin 6*c* can be adjusted. Refer to the matching structures of the tent long bones 32*c* and the extension pipes 4*c* for the specific structures.

In other alternative embodiments, the spring bean members 5*c* can be replaced by matching telescopic pins with structures such as springs, limiting lock pins and the like.

According to the present invention, the extension pipes 4*c* are designed in the optimized manner, and the tightness of the tarpaulin 6*c* can be adjusted by means of matching of the extension pipes 4*c* and the tent long bones 32*c* or the tent short bones 33*c*, thereby facilitating mounting and later maintenance of the tent; and quick-assembly and quick-disassembly structures of the extension pipes 4*c* are optimized, thereby facilitating quick fixing and mounting to the tent roof 3*c* and improving the mounting efficiency.

The above embodiments are only the preferred embodiments of the present invention, and are not intended to limit the present invention in any way. Any simple amendment, equivalent change, or modification made to the above embodiments in accordance with the technical principles of the present invention still falls within the scope of the technical solution of the present invention.

What is claimed is:

1. An outdoor tent, comprising a tent frame and a tent roof, wherein the tent roof is mounted at an upper portion of the tent frame; the tent frame comprises a plurality of stand columns and tent beams configured to connect the stand columns; the tent roof comprises a plurality of tent roof rods and a tent roof rod frame located in the middle; end plugs are arranged at top ends of the stand columns; embedding grooves are formed in the end plugs; the tent roof rods are mounted on the end plugs in a matching manner by means of brackets; and each of the brackets comprises a tent roof rod fixing portion and an embedded pipe, the tent roof rod fixing portion is configured to be fixedly mounted on the corresponding tent roof rod, and the embedded pipe is configured to match the corresponding embedding groove in a clamping manner, wherein the tent roof rod fixing portion comprises a tent roof rod bottom support surface and lug plates located on two sides of the tent roof rod bottom support surface, and a mounting groove for accommodating the corresponding tent roof rod is formed among the tent roof rod bottom support surface and the lug plates, wherein the tent roof rod bottom support surface is an outward inclined surface, mounting holes are formed in the lug plates, and a reinforcing plate is arranged between the tent roof rod fixing portion and the corresponding embedded pipe.

2. The outdoor tent according to claim 1, wherein fixing holes are formed in side walls of the stand columns corresponding to the embedding grooves, and spring bean members are arranged in the embedded pipes and are configured to match the fixing holes in a locking manner.

3. The outdoor tent according to claim 1, wherein each of the end plugs comprises an end plug body and an end plug cover, the outer diameter of the end plug cover is greater than the inner diameter of the corresponding stand column, and the end plug body is completely embedded and mounted in an inner cavity of the corresponding stand column.

4. The outdoor tent according to claim 3, wherein limiting and reinforcing ribs are arranged on an outer side wall of the end plug body.

5. The outdoor tent according to claim 1, wherein the outdoor tent further comprises section tent roof rods; outer sides of the section tent roof rods are mounted to and match the middles of tent cross beams of the tent beams; at least one embedding groove is formed in the middle of each of the tent cross beams; the embedding grooves are of an upward open structure and are configured to fixedly match mounting seats; and each of the mounting seats comprises clamping pipes configured to match the embedding grooves in an embedding manner and an assembling seat located at upper portions of the clamping pipes, and the assembling seat is configured to fixedly match the corresponding tent roof rod.

6. The outdoor tent according to claim 5, wherein there are two embedding grooves and two clamping pipes, and the embedding grooves correspondingly match the clamping pipes.

7. The outdoor tent according to claim 6, wherein the two clamping pipes are divided into a locking clamping pipe and an auxiliary clamping pipe, an elastic clamping member is arranged in the locking clamping pipe, a locking hole is formed in a side wall of each of the embedding grooves, the locking hole is configured to match and lock the elastic clamping member, and the auxiliary clamping pipe is shorter than the locking clamping pipe.

8. The outdoor tent according to claim 5, wherein each of the mounting seats further comprises side plates, clamping seams are formed between the side plates and the clamping pipes, and the clamping seams are configured to embed side walls of the embedding grooves.

9. The outdoor tent according to claim 5, wherein each of the assembling seats comprises lug plates and a bottom support plate, the lug plates are located on two sides of the bottom support plate to form an assembling groove, the assembling groove is configured to match the corresponding tent roof rod for mounting, and fixing holes are formed in the lug plates.

10. The outdoor tent according to claim 5, wherein each of the tent cross beams comprises a first cross beam frame and a second cross beam frame, the first cross beam frame and the second cross beam frame are mounted in an attached and fastened manner by means of a connector, and the two embedding grooves are located at ends of the first cross beam frame and the second cross beam frame respectively.

11. The outdoor tent according to claim 1, wherein an upper portion of the tent roof is covered with a tarpaulin; the tent roof comprises a plurality of tent long bones, one end of each of the plurality of tent long bones is mounted in a matching manner by means of a tent roof disc, the other end of each of the plurality of tent long bones extends outwards to form a free end, the free ends of some or all of the tent long bones are provided with extension pipes in a matching manner, the extension pipes are configured to match the free ends of the tent long bones in a sleeving manner, the extension pipes are configured to match the tent long bones to realize extension and adjustment of the lengths of the free ends, and the extension pipes are configured to fixedly match an edge of the tarpaulin.

12. The outdoor tent according to claim 11, wherein each of the extension pipes comprises a pipe body, a pipe cavity and a pipe head, at least two locking holes are formed in the pipe body, the locking holes are in communication with the pipe cavity, a sliding groove opening is further formed in the pipe body, and the sliding groove opening is located at an end opening of the pipe cavity.

13. The outdoor tent according to claim 12, wherein three locking holes are formed in the pipe body.

14. The outdoor tent according to claim 12, wherein upper portions of the stand columns are configured to match the tent long bones for mounting, and the free ends of the tent long bones are provided with the extension pipes in a matching manner.

15. The outdoor tent according to claim 14, wherein the free ends of the tent long bones are provided with spring bean members in a matching manner, and spring bean portions of the spring bean members protrude out of outer side walls of the tent long bones.

16. The outdoor tent according to claim 12, wherein the tent roof further comprises tent short bones, the tent short bones are mounted on the tent long bones by means of support rods, and the tent short bones are configured to support the tarpaulin.

17. The outdoor tent according to claim 16, wherein outer side ends of the tent short bones are provided with extension pipes in a matching manner.

18. The outdoor tent according to claim 17, wherein outer ends of the tent short bones are provided with spring bean members in a matching manner, and spring bean portions of the spring bean members protrude out of outer side walls of the tent short bones.

* * * * *